US005782110A

United States Patent [19]

Kim

[11] Patent Number: 5,782,110

[45] Date of Patent: Jul. 21, 1998

[54] CLOTHES WASHING MACHINE WITH BALANCING DEVICE

[75] Inventor: Do Weon Kim, Seoul, Rep. of Korea

[73] Assignee: Samsung Electronics Co., Ltd., Suwon, Rep. of Korea

[21] Appl. No.: 697,666

[22] Filed: Aug. 28, 1996

[30] Foreign Application Priority Data

| | | | |
|---|---|---|---|
| Aug. 28, 1995 | [KR] | Rep. of Korea | 1995-26947 |
| Aug. 28, 1995 | [KR] | Rep. of Korea | 1995-26949 |
| Aug. 28, 1995 | [KR] | Rep. of Korea | 1995-26950 |
| Aug. 28, 1995 | [KR] | Rep. of Korea | 1995-26951 |
| Aug. 28, 1995 | [KR] | Rep. of Korea | 1995-26952 |

[51] Int. Cl.[6] ..... D06F 37/24

[52] U.S. Cl. ..... 68/23.3; 68/23.2; 210/144; 74/573 R; 74/573 F

[58] Field of Search ..... 68/23.2, 23.3; 210/144; 74/573 R, 573 F

[56] References Cited

U.S. PATENT DOCUMENTS

| | | | |
|---|---|---|---|
| 4,044,626 | 8/1977 | Hayashi et al. | 68/23.2 |
| 5,460,017 | 10/1995 | Taylor | 74/573 R |

FOREIGN PATENT DOCUMENTS

| | | | |
|---|---|---|---|
| 53-14975 | 3/1978 | Japan | 68/23.2 |
| 54-140064 | 10/1979 | Japan | 68/23.2 |
| 54-160065 | 12/1979 | Japan | 68/23.2 |
| 58-37353 | 3/1983 | Japan | 68/23.2 |
| 58-137638 | 8/1983 | Japan | 68/23.2 |
| 2104553 | 3/1983 | United Kingdom | 68/23.2 |

*Primary Examiner*—Frankie L. Stinson

*Attorney, Agent, or Firm*—Burns, Doane, Swecker & Mathis, L.L.P.

[57] ABSTRACT

A washing machine includes a spin basket rotatable about a vertical axis and having a dynamic balancer mounted thereon. The balancer includes coaxial annular passageways arranged horizontally next to one another. Each passageway contains oil and a group of freely movable balls. The heights of the passageways increase in a radially outward direction, and the sizes and weights of the groups of balls increase in a radially outward direction.

8 Claims, 9 Drawing Sheets

CLOTHES WASHING MACHINE WITH BALANCING DEVICE

BACKGROUND OF THE INVENTION

1. Field of the Invention

The present invention relates to a clothes washing machine equipped with a balancing device located around the upper section of a spin basket cylinder. More particularly, it relates to a washing machine including a balancing device in which a plurality of passageways are formed to contain balls.

2. Discussion of Related Art

FIG. 9 depicts a side-sectional view of a washing machine with a conventional balancing device 6. The balancing device 6 is installed along the outer circumferential surface of an opening 3A of an inner cylinder or spin basket 3 rotatable around an axis of rotation S—S.

The balancing device 6 being concentric with the axis has an annular passageway 6A. This passageway 6A contains a liquid 6B such as a saline solution. The inner cylinder 3 is rotated with a pulsator 4 within an outer cylinder 2 upon operation of a driving unit 5. As the inner cylinder 3 rotates at high speeds, laundry L tends to gather around one spot within the inner cylinder 3, and the liquid 6B flows into the opposite side of the laundry L so as to offset the imbalance. At this point, a center of rotation T—T corresponding to the liquid 6B that flows into the one side is moved to cause the eccentric displacement "e" with respect to the geometric center S-S. This makes the rotary axis of the inner cylinder 3 deviate from the geometric center S—S, and induces the vibration and abnormal abrasion of bearings for supporting the rotation, which reduces the reliability of the washing machine. To obviate the above-mentioned problems, balls made of steel or stainless steel have been used instead of a liquid, in order to remove the eccentric displacement between the center of rotation and the geometric center. According to this technique, however, since a plurality of the same sized balls are located in one passageway, they cannot dynamically balance the out-of-balance rotating inner cylinder due to the laundry situated to one side with respect to the center of the interior of the inner cylinder.

SUMMARY OF THE INVENTION

Accordingly, the present invention is directed to a washing machine with a balancing device that substantially obviates one or more of the problems due to the limitations and disadvantages of the related art.

It is an object of the prensent invention to provide a washing machine equipped with a balancing device in which a plurality of passages are formed to contain balls for the purpose of dynamically counteracting imbalances due to a variation in the center of gravity of laundry.

Additional features and advantages of the invention will be set forth in the description which follows, and in part will be apparent from the description, or may be learned by practice of the invention. The objectives and other advantages of the invention, will be realized and attained by the structure particularly pointed out in the written description as well as the appended drawings.

To achieve these and other advantages and in accordance with the purpose of the present invention, as embodied and broadly described, the inventive washing machine includes a housing; an outer cylinder held by suspension arms in the housing; an inner cylinder rotatable around an axis of rotation in the outer cylinder; and a balancing device mounted on the inner cylinder and being concentric with the axis of rotation. The balancing device has a plurality of radially spaced annular passageways in which oil is contained.

The radially innermost passageway is designed to have the height of all the passageways and the outermost passageway is designed to have the largest height. Further, a plurality of balls are located in each of the passageways.

It is to be understood that both the foregoing general description and the following detailed description are exemplary and are intended to provide further explanation of the invention.

BRIEF DESCRIPTION OF THE ATTACHED DRAWINGS

DETAILED DESCRIPTION OF THE PREFERRED EMBODIMENT

Reference will now be made in detail to the preferred embodiments of the present invention, examples of which are illustrated in the accompanying drawings.

Figure 1:
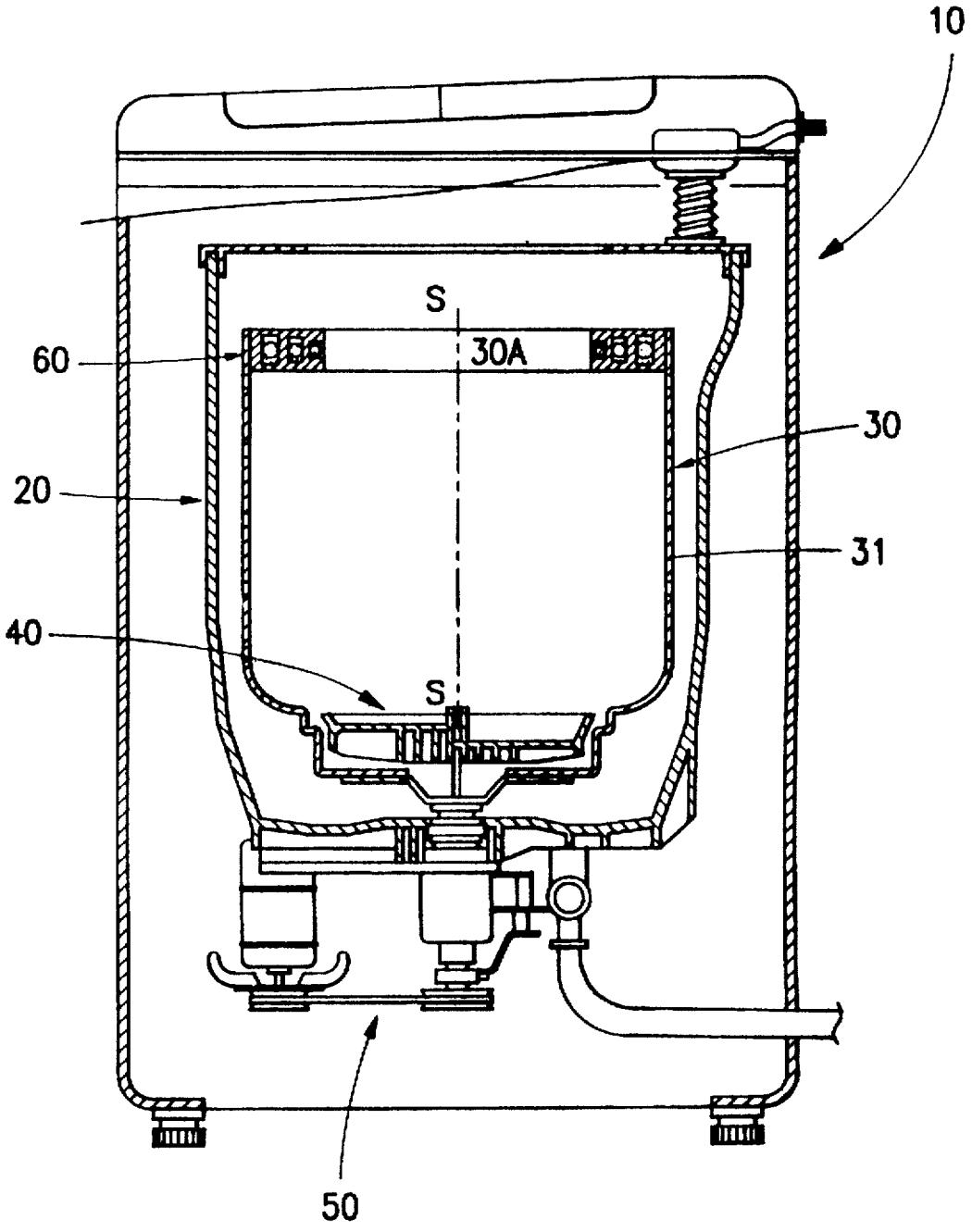
FIG. 1 depicts a side-sectional view of a washing machine with a balancing device in accordance with the present invention.

FIG. 1 depicts a side-sectional view of a washing machine with a balancing device in accordance with the present invention.

As shown in FIG. 1, the washing machine includes a housing 10, an outer cylinder 20 which is a water retaining cylinder held by suspension arms (not illustrated) within the housing 10, and an inner cylinder or spin basket 30 which serves as a hydro-extractor with drain holes and rotatably mounted within the outer cylinder 20. The washing machine also includes a pulsator 40 that is formed on the bottom inside of the inner cylinder 30, a driving unit 50 that is installed under the outer cylinder 20 to rotate the inner cylinder 30 and the pulsator 40, and a balancing device 60 that is coupled to the inner circumferential surface of an opening 30A by the use of a snap-in coupling or it can be integrally mounted thereon.

Figure 2:
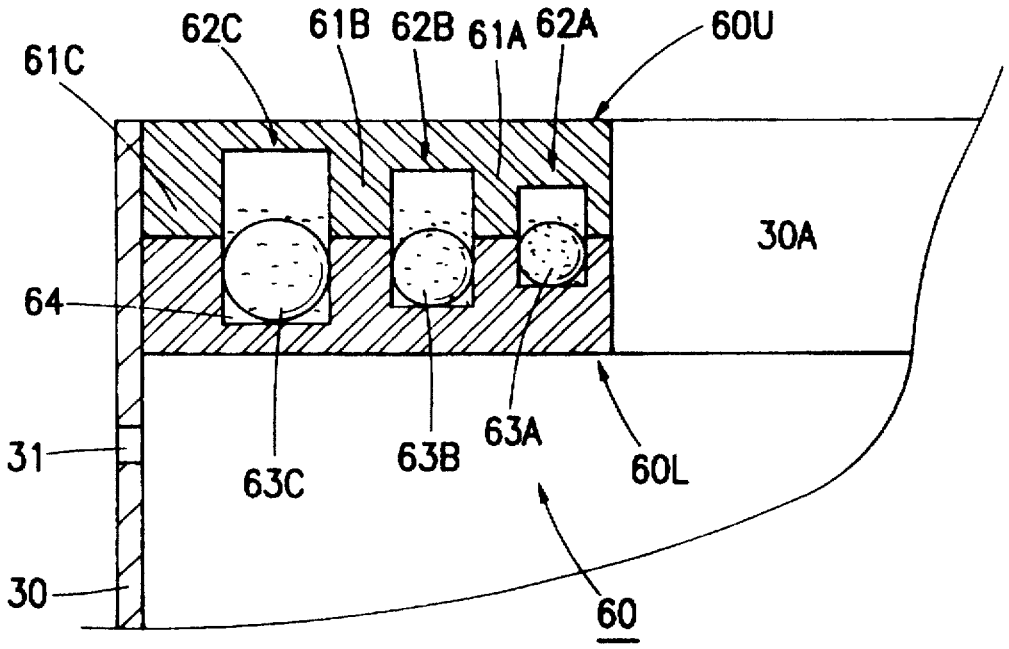
FIG. 2 depicts an enlarged-sectional view of a balancing device in accordance with a first preferred embodiment of the present invention.

FIG. 2 depicts an enlarged-sectional view of the balancing device 60 in accordance with a first preferred embodiment of the present invention.

The balancing device 60 includes a casing formed of flat ring-shaped upper and lower bodies 60U and 60L. The upper and lower bodies 60U and 60L are united to each other by thermal bonding. In the balancing device 60 they are a plurality of annular passageways 62A, 62B and 62C space apart transverse to the axis of rotation S—S. These passageways are designed to be different in cross sectional size. In other words, the passageway 62A near the opening 30A is the smallest of the three while the passageway 62C near the outer cylinder 30 is the largest.

First, second and third groups of balls 63A, 63B and 63C are freely movable in respertive ones of the passageways 62A, 62B and 62C, and the balls are arranged so as to correspond in size to the passageways. In other words, of the three balls shown in FIG. 2, the first ball 63A nearest the opening 30A is the smallest and lightest of the three, and the third ball 63C nearest the outer cylinder 30 is the biggest and heaviest of all. The second ball 63B is bigger and heavier than the first ball 63A, and smaller and lighter than the third ball 63C. According to the present invention, when the third ball 63C has a size and weight valve of 1.0, the second ball 63B has a size and weight value of 0.7 to 0.8, and the first ball 63A has a size and weight value of 0.3 to 0.4 . The balls are preferably made of steel or stainless steel.

Each outer diameter of the balls is preferably smaller than a height of a respective highway 0.2 to 0.5 mm. In addition, passageways 62A, 62B and 62C are filled with a high-viscosity oil 64 so as to reduce the friction between the balls 63A, 63B and 63C and their respective passageways 62A, 62B and 62C. A silicon oil, PAG or mineral oil may be used as the high-viscosity oil 64. According to the present invention, when the viscosity of the oil 64 in the third passageway 62C has a value of 1.0, the viscosity of the oil in the second passageway 62B has a value of 0.7 to 0.8, and that of the oil in the third passageway 62C is 0.2 to 0.3.

Each corner of the passageways 62A, 62B and 62C is preferably curved in order to facilitate the flow of the oil 64 and the movement of the balls and to enhance the durability of the passageways as well.

A first divider 61A is formed between the first and second passageways 61A and 62B, and there are also a second divider 61B formed between the second and third passageways 62B and 62C and a third divider 61C formed between the third passage 62C and the inner cylinder 30.

The first divider 61A is designed to be the thinnest of all, and the third divider 61C is the thickest of the three. The second divider 61B is designed to be thinner than the third divider 61C and thicker than the first divider 61A.

As mentioned above, the farther that the passageways, balls and dividers become distanced from the axis S—S, the more larger are: the sectional area of the passageways, the size and weight of the balls, and the thickness of the dividers in order to counteract the centrifugal force which is most largely acting on the outermost ones of the passageways, balls and dividers during the high-speed rotation of the inner cylinder 30.

Figure 3:
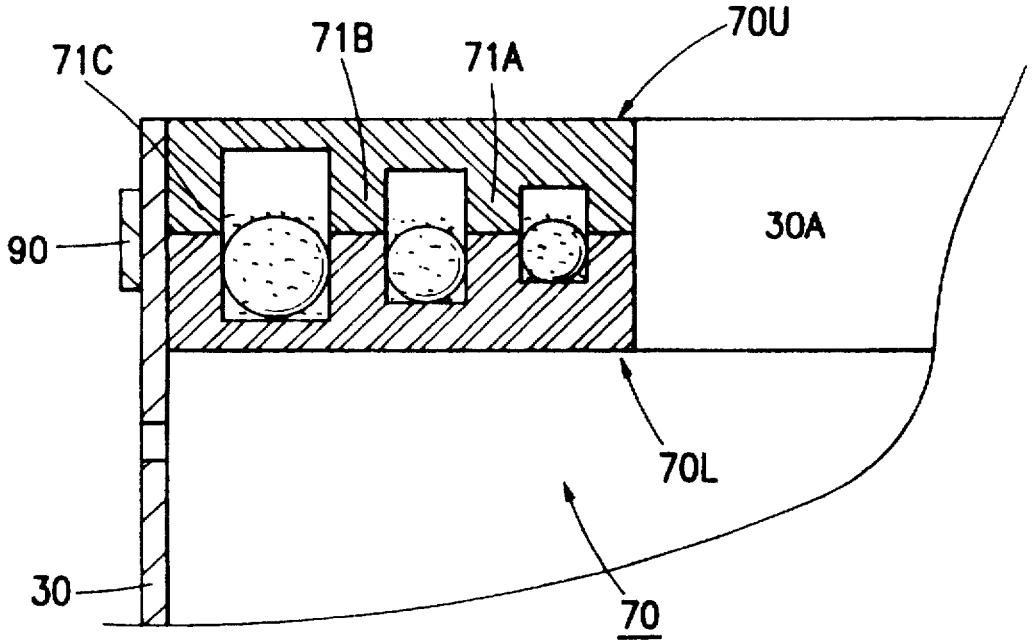
FIG. 3 depicts an enlarged-sectional view of a balancing device in accordance with a second preferred embodiment of the present invention.

FIG. 3 is an enlarged-sectional view of a balancing device 70 in accordance with a second preferred embodiment of the present invention.

The balancing device 70 of the second preferred embodiment, includes first, second and third dividers 71A, 71B and 71C which are all the same thickness, which differs from the first preferred embodiment of FIG. 2.

A reinforcing member 90 in the form of a band is installed on the periphery of the third divider 71C. The reinforcing member 90 serves to strengthen a spot where an upper body 70U is connected to a lower body 70L by thermal bonding and which may have poor adhesive strength due to the centrifugal force acting thereon during the high-speed rotation of the inner cylinder 30. Rubber or synthetic resin with elasticity may be used as the reinforcing member 90, but the reinforcing member 90 is preferably made from a metallic material.

Figure 4:
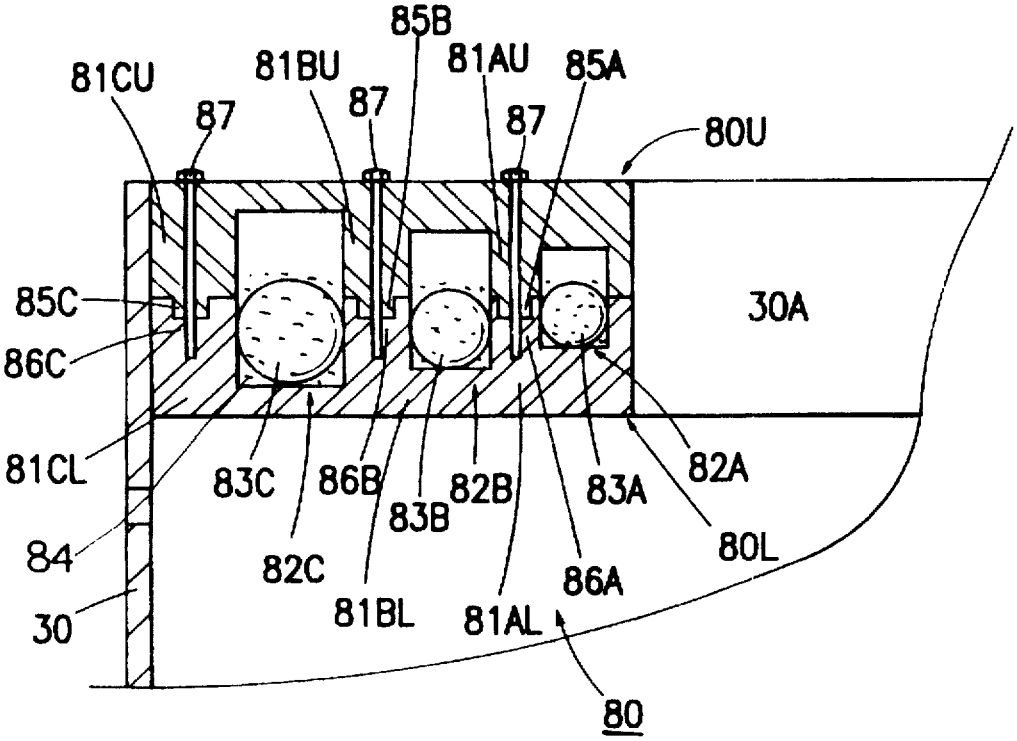
FIG. 4 depicts an enlarged-sectional view of a balancing device in accordance with a third preferred embodiment of the present invention.
Figure 7:
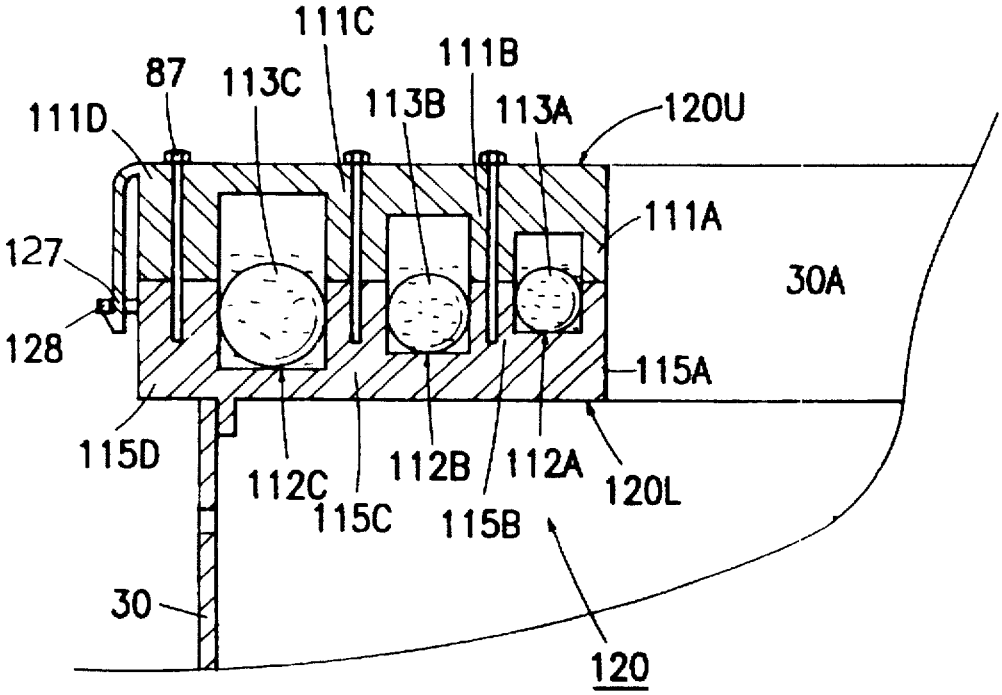
FIG. 7 depicts an enlarged-sectional view of a balancing device in accordance with a sixth preferred embodiment of the present invention.

FIGS. 4 and 7 depict balancing devices formed of upper and lower bodies which can be separated from each other.

Referring to FIG. 4, a balancing device 80 includes upper and lower bodies 80U and 80L. The upper body 80U has a divider 8LAU formed between passageways 82A and 82B, a divider 81BU formed between passageways 82B and 82C, and a divider 81CU located between the passageway 82C and an inner cylinder 30. Likewise, the lower body 80L has corresponding dividers 81AL, 81BL and 81CL.

When it comes to the thickness of the dividers, the radially innermost dividers 81AU and 81AL are the thinnest, and the radially outermost dividers 81CU and 81CL are the thickest. Regarding the horizontal dimensions of the passageways, that of the radially innermost passageway 82A is designed to be the smallest of all the passageways, and that of the radially outermost passageway 82C is the largest. Of the three balls shown in FIG. 4, the radially innermost ball 83A is the radially smallest and the lightest of all the balls, and the outermost ball 83C is the biggest and the heaviest.

The region where the upper body 80U is joined to the lower body 80L has convexities 85A, 85B and 85C and concavities 86A, 86B and 86C so as to facilitate the connection of the upper body 80U with the lower one 80L. According to the present invention, the convexities 85A, 85B and 85C are respectively provided on the upper dividers 81AU, 81BU and 81CU, and the concavities 86A, 86B and 86C are provided in the lower dividers 81AL, 81BL and 81CL each. These convexities and concavities could have other shapes.

The upper body 80U is secured to the lower body 80L by the use of screws 87. Alternatively, a bolt and a nut may be used to fasten the upper body 80U to the lower body 80L. In the meantime, packing may be applied to the region where the upper body 80U and the lower body 80L are joined together so as to prevent the leakage of oil 84 from each passageway 82A, 82B and 82C.

Figure 5:
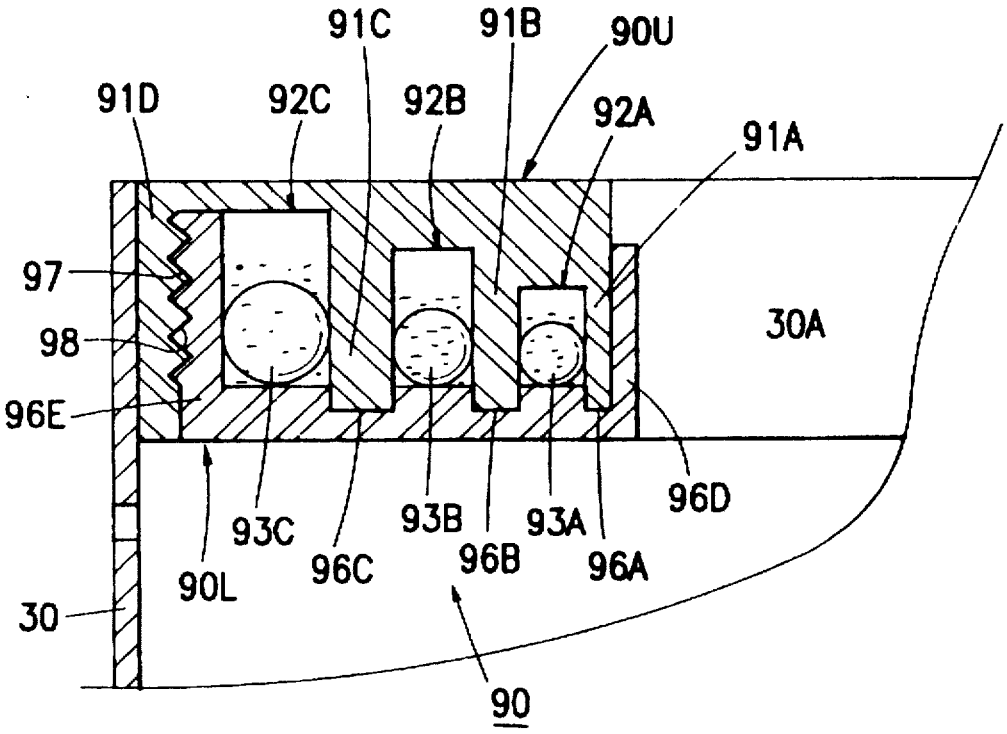
FIG. 5 depicts an enlarged-sectional view of a balancing device in accordance with a fourth preferred embodiment of the present invention.

Referring now to FIG. 5, a balancing device 90 includes upper and lower bodies 90U and 90L joined to each other. The upper body 90U has first, second, third and fourth dividers 91A, 91B, 91C and 91D extending downward. The first divider 91A is the thinnest of all the dividers, and the third divider 91C is thicker than the second one 91B. The radially outermost divider 91D may be thinner than the third divider 91C, and it is important that when the divider 91D is coupled to a divider 96E of the lower body 90L, the combined thickness of the coupled dividers 91D and 96E is thicker than that of the third divider 91C.

The radially outermost divider has a female screw part 97 on its inner wall, and passageways 92A, 92B and 92C are located between the dividers 91A, 91B, 91C and 96E. The sectional area of the radially innermost passageway 92A is the smallest of all the passageways, and that of the radially outermost passageway 92C near the inner cylinder 30 is the largest.

The lower body 90L has a first divider 96D extending upward to surround the first divider 91A of the upper body 90U, and the second divider 96E extends upward on the radially outermost end of the lower body 90L.

A male screw part 98 is formed on the outer wall of the second divider 96E to be coupled to the female screw part 97 of the upper body 90U. Between the first and second dividers 96D and 96E, there is a first groove 96A for supporting the lower part of the first divider 91A of the upper body 90U, a second groove 96B for supporting the lower part of the second divider 91B, and a third groove 96C for supporting the lower part of the third divider 91C.

A width of these grooves 96A, 96B and 96C is designed to correspond to a thickness of respective dividers 91A, 91B and 91C. In other words, the first groove 96A is the narrowest of all the grooves, and the third groove 96C is wider than the second groove 96B. Balls 93A, 93B and 93C different from each other in size and weight and are positioned in passage 92A, 92B and 92C, respectively.

Figure 6:
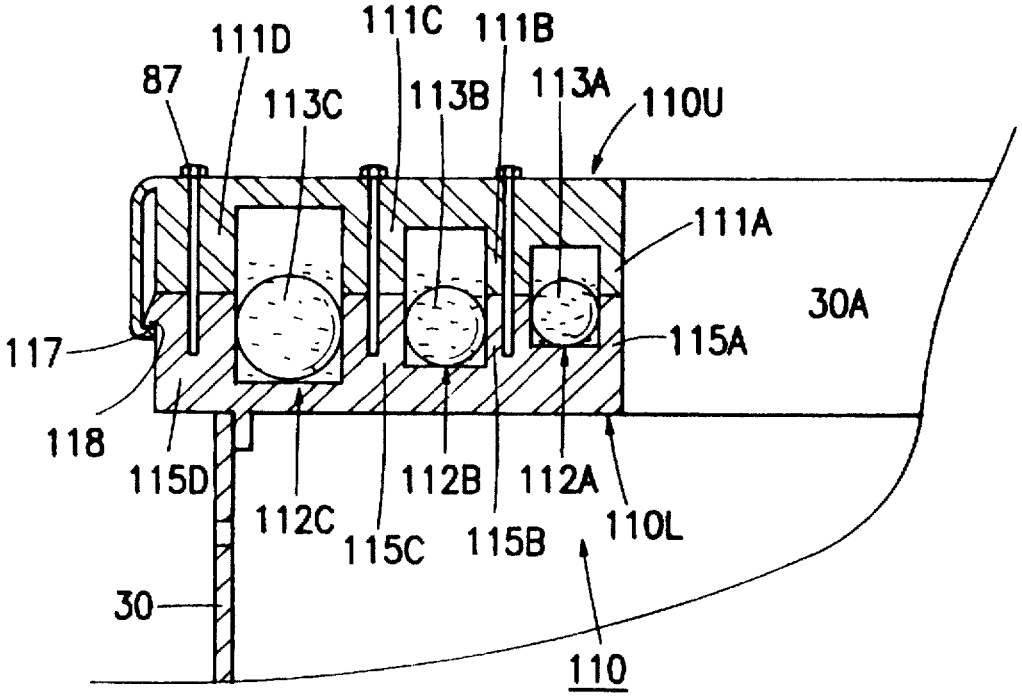
FIG. 6 depicts an enlarged-sectional view of a balancing device in accordance with a fifth preferred embodiment of the present invention.

FIG. 6 is an enlarged-sectional view of a balancing device in accordance with a fifth preferred embodiment of the present invention.

A balancing device 110 includes upper and lower bodies 110U and 110L that can be separated from each other. The upper body 110U has first, second, third and fourth dividers 111A, 111B, 111C and 111D extending downward. The lower body 110L has first, second, third and fourth dividers 115A, 115B, 115C and 115D extending upward. The radially innermost dividers 111A and 115A are the thinnest of all the dividers, and the radially outermost dividers 111D and 115D are the thickest of all. The third dividers 111C and 115C are thicker than the second dividers 111B and 115B.

First, second and third passageways 112A, 112B and 112C are formed between the dividers 111A, 115A, 111B, 115B, 111C, 115C, 111D and 115D. When it comes to their sectional areas, the first passageway 112A is the smallest one of all the passageways, and the third passageway 112C is the largest. Balls 113A, 113B and 113C are respectively positioned in the first, second and third passageways 112A, 112B and 112C as explained earlier. The balls are formed to have the a size and weight that correspond to each sectional area of the passageways 112A, 112B and 112C as explained earlier. A hook 117 is formed to project toward the lower body 110L on the outer wall of the outermost divider 111D of the upper body 110U, and a projection 118 is formed on the radially outer wall of the radially outermost divider 115D of the lower body 110L in order that the hook 117 engages under the projection 118.

The upper body 110U is secured to the lower body 110L by the use of screws 87. To join the upper and lower bodies 110U and 110L together, a bolt and a nut could be in use.

FIG. 7 depicts a sixth embodiment of a balancing device which modifies the fifth preferred embodiment of the present invention.

A balancing device 120 includes upper and lower bodies 120U and 120L that can be separated from one another. A hook 127 is formed on the outer wall of the outermost divider 111D to extend downward and to have a radially outwardly projecting end. An eye 128 is formed on the radially outer wall of the outermost divider 115D of the lower body 120L so that the hook 127 fits into the eye 128 for fastening.

The following description concerns the operation of the washing machine with the balancing device in accordance with the present invention.

The inner cylinder 30 and the pulsator 40 rotate together by the operation of the driving unit 50, and thereby the balancing device 60, 70, 80, 90, 110 or 120 turns to freely move the balls in each passageway.

Figure 8:
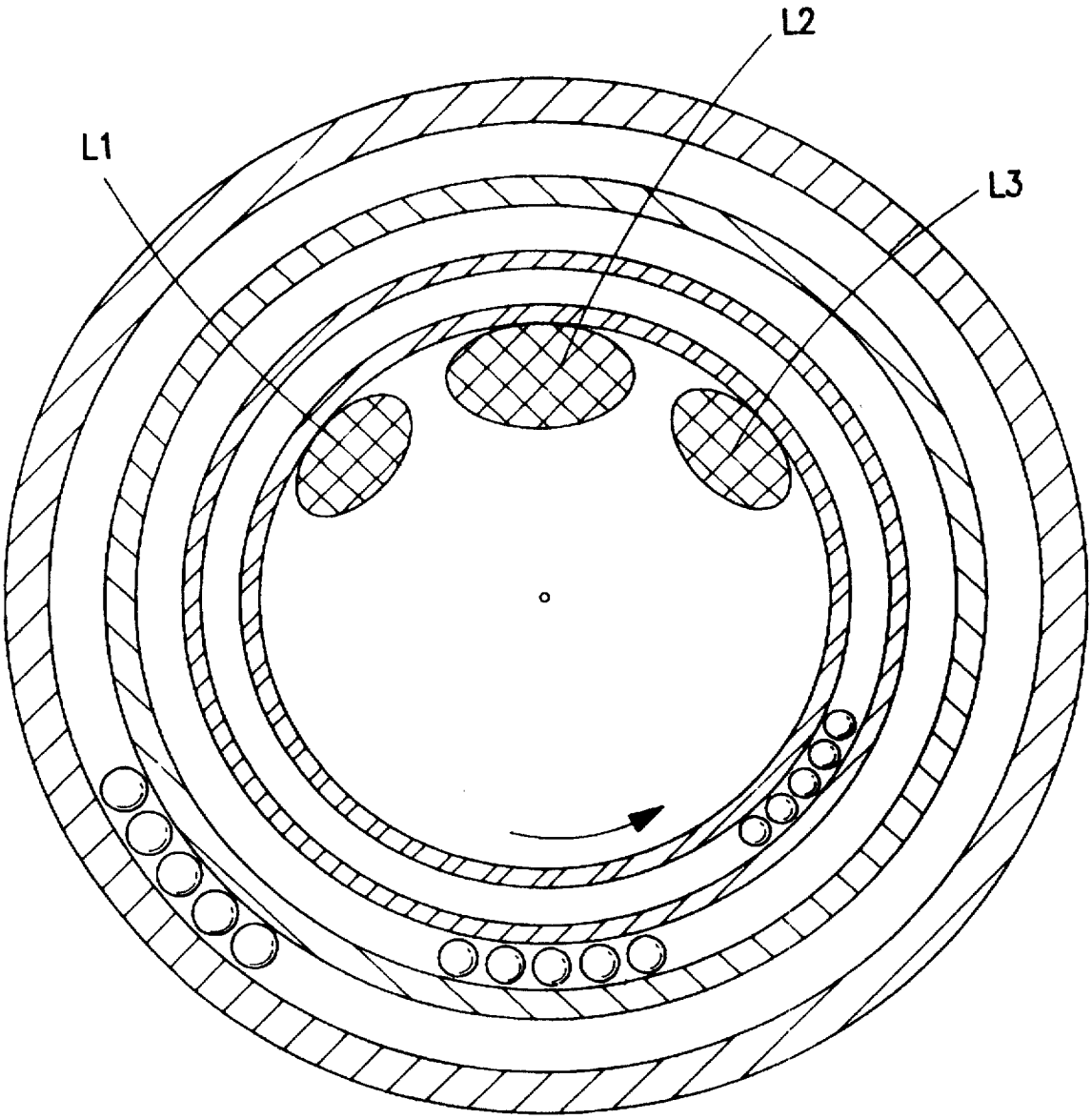
FIG. 8 is a view for illustrating the operation of the balancing device in accordance with the present invention.
Figure 9:
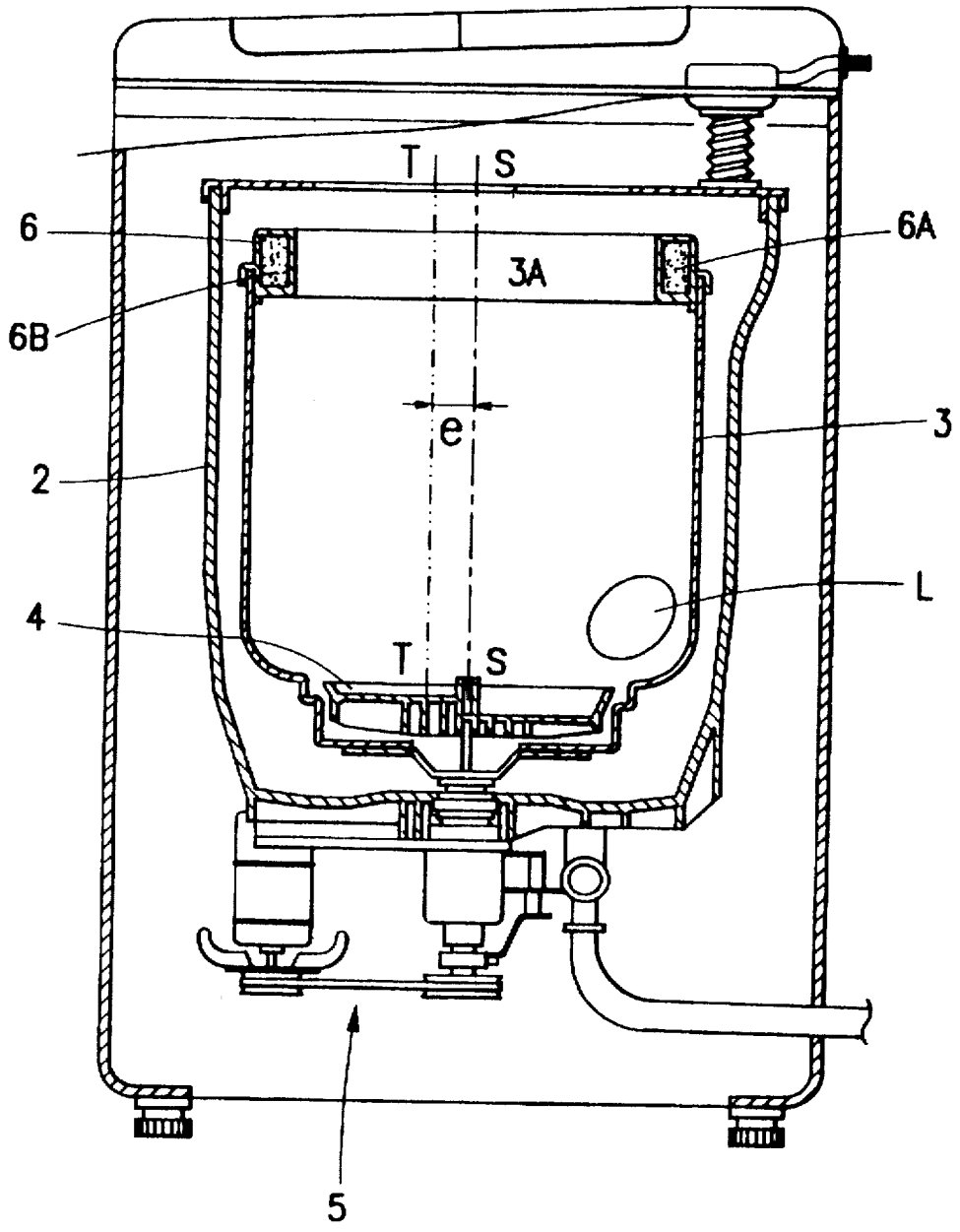
Fig 9 (Prior Art)
FIG. 9 depicts a side-sectional view of a washing machine with a conventional balancing device.

As shown in FIG. 8, when the articles L1, L2 and L3 to be dried are positioned in different spots and create an out-of-balance condition, the three sets of different weight and sized balls move to the opposite sides of the articles L1, L2 and L3 to counteract the imbalances. Accordingly, the inventive balancing device dynamically balances the out-of-balance rotating inner cylinder 30 in such a manner that the inner cylinder 30 can rotate at high speeds without any vibration and noise.

As discussed above, the movable balls in each passageway of the balancing device are positioned at the opposite side of the laundry gathering on one spot within the inner cylinder 30 so that they can remove imbalances when the inner cylinder rotates at high speeds to remove excess water from the laundry. Therefore, the present invention can minimize the vibration and noise made by the unbalance condition of the inner cylinder 30 and prevent any abrasion of the components whereby the reliability of a washing machine is enhanced. Besides, it is easy to manufacture the inventive balancing device, and the present invention can increase manufacturing productivity.

It will be apparent to those skilled in the art that various modifications and variations can be made in a washing machine with a balancing device of the present invention without departing from the spirit or scope of the invention. Thus, it is intended that the present invention cover the modifications and variations of this invention provided they come within the scope of the appended claims and their equivalents.

What is claimed is:

1. A clothes washing machine comprising:

a housing;

an outer cylinder suspended in the housing;

an inner cylinder rotatable around an axis of rotation in the outer cylinder;

balancing means provided to the inner cylinder and being concentric with the axis of rotation; the balancing means comprising a plurality of annular passageways in which oil is contained, the passages arranged horizontally next to one another and being coaxial, a radially innermost one of the passageways with respect to said axis having a smallest height, and a radially outermost one of the passageways having a largest height; and annular dividing walls extending between adjacent passageways, a radially innermost one of the dividing walls being a thinnest of all the dividing walls, and a radially outermost one of the dividing walls being a thickest of all of the dividing walls.

2. A washing machine according to claim 1, wherein a plurality of balls is located in each of the passageways.

3. A washing machine according to claim 2, wherein the balls located in a radially innermost passageway are the lightest of all the balls, and the balls in the radially outermost passageway are the heaviest.

4. A washing machine according to claim 2, wherein the balls in the radially innermost passageway are the smallest of all the balls, and the balls in the radially outermost passageway are the largest.

5. A washing machine according to claim 1, wherein an annular reinforcing means extends around a radially outer wall of the casing.

6. A washing machine according to claim 1, wherein said casing is split into upper and lower bodies.

7. A washing machine according to claim 6, wherein said upper body includes upper divider wall portions separating adjacent ones of said passageways, and said lower body includes lower divider wall portions engaging said upper wall portions.

8. A washing machine according to claim 7, wherein the upper and lower divider wall portions engage one another by cooperating concave/convex surfaces.

* * * * *